United States Patent [19]

Moller et al.

[11] Patent Number: 4,612,651

[45] Date of Patent: Sep. 16, 1986

[54] HEAT TREATING FURNACE WITH HEATING ELEMENT HANGERS AND RADIATION SHIELD SPACERS

[75] Inventors: Craig A. Moller, Loves Park; Eric H. Wolter, Cherry Valley, both of Ill.

[73] Assignee: Abar Ipsen Industries, Feasterville, Pa.

[21] Appl. No.: 613,281

[22] Filed: May 24, 1984

[51] Int. Cl.[4] ..... F27B 5/04

[52] U.S. Cl. ..... 373/130; 373/137; 373/110

[58] Field of Search ..... 373/109, 110, 111, 130, 373/134, 137, 128; 219/390, 408, 539, 541, 552, 553, 542; 338/43–45, 288, 289, 294, 295, 315, 320

[56] References Cited

U.S. PATENT DOCUMENTS

| | | | |
|---|---|---|---|
| 3,327,041 | 6/1967 | Clune et al. | 373/110 |
| 3,456,935 | 7/1969 | Bornor | 263/40 |
| 4,156,792 | 5/1979 | McFadden et al. | 373/130 |
| 4,259,538 | 3/1981 | Jones | 13/25 |

*Primary Examiner*—Roy N. Envall, Jr.

*Attorney, Agent, or Firm*—Leydig, Voit & Mayer, Ltd.

[57] ABSTRACT

The electric resistance heating elements of a heat treating furnace are suspended within a work chamber by hanger rods threaded into nuts which are welded to the inside of the outer wall of the chamber to avoid the need for forming holes through the outer wall. Spacers are supported by adjacent hanger rods and hold thin radiation shields in spaced relation over the entire span extending from rod-to-rod.

12 Claims, 6 Drawing Figures

HEAT TREATING FURNACE WITH HEATING ELEMENT HANGERS AND RADIATION SHIELD SPACERS

BACKGROUND OF THE INVENTION

This invention relates generally to a heat treating furnace and, more particularly, to a heat treating furnace of the type in which electric resistance heating elements are disposed inside of a work chamber to radiantly heat workpieces therein.

In some respects, the work chamber of the present furnace is similar to that disclosed in Bornor U.S. Pat. No. 3,456,935. Thus, the work chamber is defined within a walled enclosure having an outer wall and having radiation shielding packs attached to the inner side of the outer wall. Each shielding pack comprises a series of thin shields or plates made of temperature-resistant sheet metal and spaced inwardly from one another and from the outer wall of the chamber. The spaced shields serve to thermally insulate the chamber and to reflect radiation from the heating elements back to the workpieces in the chamber.

The electric resistance heating elements of the present furnace are attached to and are suspended from the outer wall of the work chamber by a plurality of hanger rods which extend inwardly through the radiation shields, the inner end portions of the hanger rods being connected to and being insulated electrically from the heating elements. Both the afore-mentioned Bornor patent and Jones U.S. Pat. No. 4,259,538 disclose hanger rods for supporting electric heating elements. In each instance, the hanger rods extend through holes in the outer wall of the chamber and are anchored by nuts located in and closing off the holes.

SUMMARY OF THE INVENTION

One of the objects of the present invention is to provide a heat treating furnace having new and improved heating element hanger rods which are attached to the outer wall of the chamber in a novel manner simplifying installation of the rods and avoiding the need for piercing and re-closing the outer wall adjacent the outer ends of the rods.

A further object of the invention is to use the hanger rods to uniquely support spacers which extend between adjacent rods and which hold the thin radiation shields in spaced relation across the entire span from rod-to-rod.

The invention also resides in the shape of the spacers to reduce heat transfer through the spacers and in the novel construction by which the hanger rods are connected to and are insulated electrically from the heating elements.

These and other objects and advantages of the invention will become more apparent from the following detailed description when taken in conjunction with the accompanying drawings.

DETAILED DESCRIPTION

Figure 1:
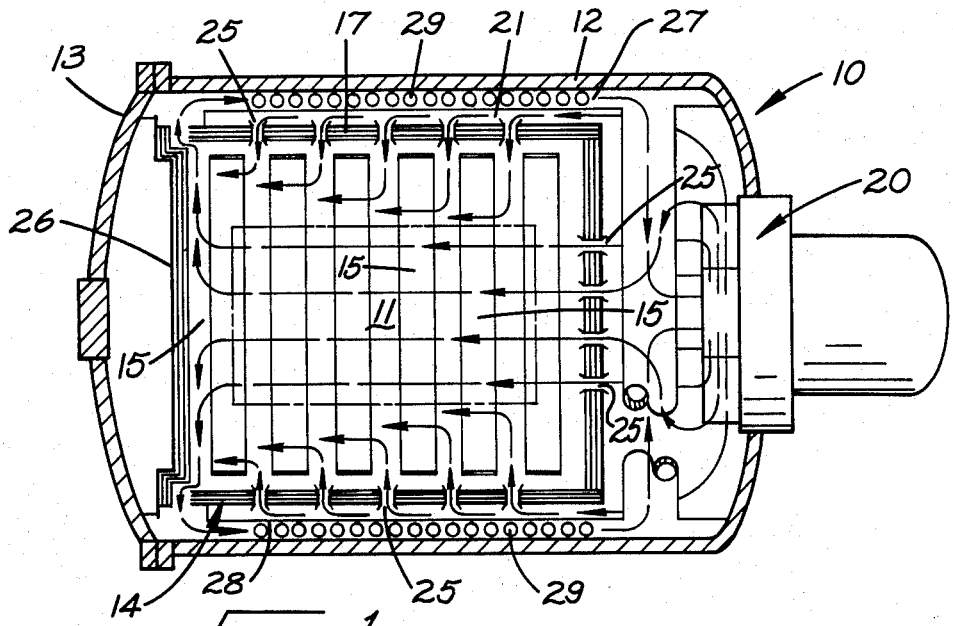
FIG. 1 is a schematic cross sectional view taken longitudinally through a heat treating furnace equipped with new and improved hanger rods and shield spacers incorporating the unique features of the present invention.

For purposes of illustration, the invention is shown in the drawings in conjunction with a vacuum furnace 10 for heat treating workpieces (not shown) in a chamber 11. In general, the furnace comprises an outer shell 12 formed with a circular cross-section and closed at its forward end by a releasable door 13. The heating chamber 11 is defined within a walled enclosure 14 disposed inside of the shell and spaced inwardly from the walls thereof. Several electric resistance heating elements 15 are located within the internal enclosure 14.

Herein, the internal enclosure 14 also is of circular cross-section and includes a circular side wall and a flat rear wall. Each wall is defined by a metal outer wall member or plate 16 (FIG. 4) and by a pack of six face-to-face radiation shields 17 spaced inwardly from one another and from the inner side of the outer plate. The shields are made from thin sheets of high temperature metal such as molybdenum and serve to insulate the chamber 11 from the shell 12 and to reflect radiation from the heating elements 15 back into the chamber.

After the workpieces have been heated, a motor-driven blower 20 at one end of the shell 12 circulates an inert cooling gas such as argon or nitrogen through the chamber 11 in order to quench the workpieces. As shown schematically in FIG. 1, the gas is directed into the space 21 between the shell 12 and the enclosure 14 and flows into the chamber through tubular nozzles 25 located in the wall of the enclosure 14. The gas discharged out of the chamber 11 flows past a shielding pack 26 on the door 13 and returns to the blower 20 via a plenum 27 defined between the shell 12 and a jacket 28 which encircles the enclosure 14. Banks of cooling coils 29 are located in the plenum and chill the gas during its return flow.

Figure 2:
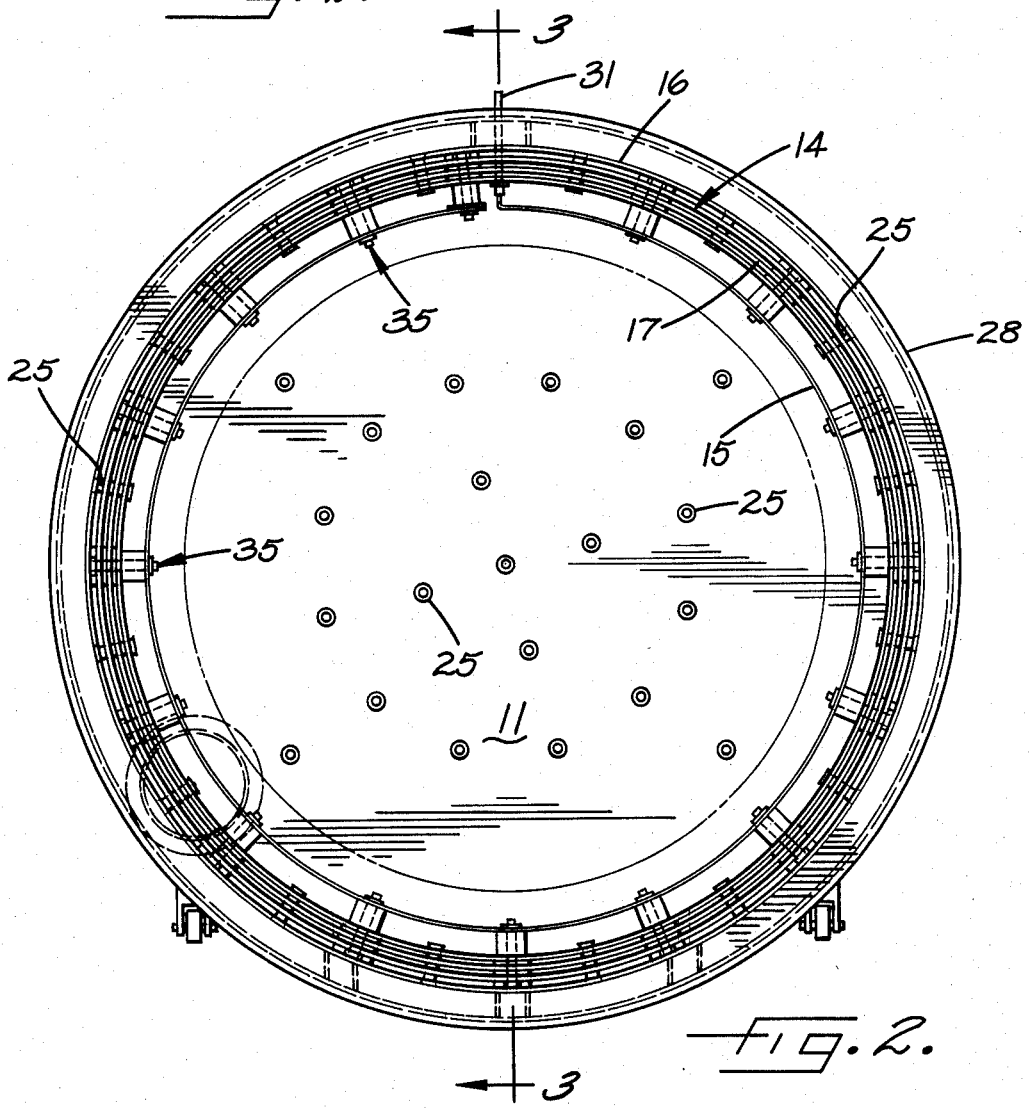
FIG. 2 is an enlarged cross-section taken transversely through the internal portion of the furnace shown in FIG. 1.

As shown in FIG. 2, each of the heating elements 15 preferably but not necessarily is in the form of a circular metal band which is spaced inwardly from the innermost radiation shield 17. One end of each heating element is connected to a power terminal or bus bar 31 which, in turn, is connected to a suitable voltage source (not shown).

Each heating element 15 is suspended from the outer wall 16 of the enclosure 14 by a circular array of hanger rods 35 which extend through the shields 17 and through holes 36 (FIG. 4) in the heating element. Each hanger rod is made of temperature-resistant metal and includes a threaded outer end portion 37.

Figure 4:
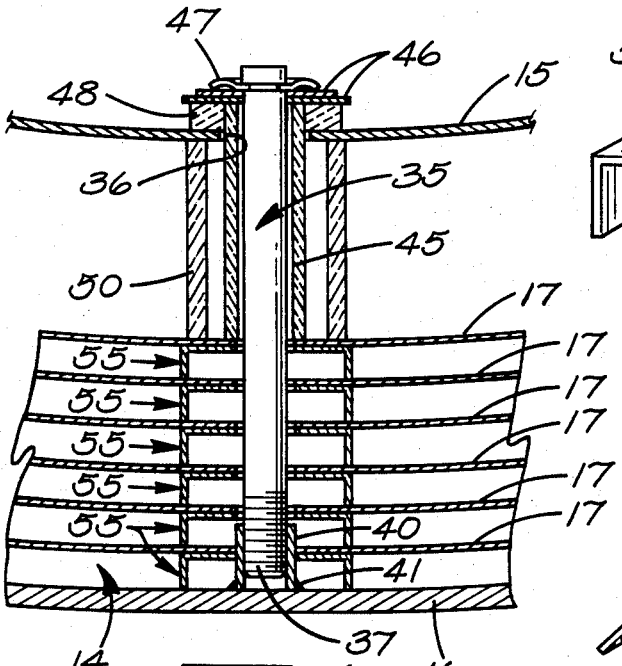
FIG. 4 is an enlarged fragmentary cross-section taken substantially along the line 4—4 of FIG. 3.

In accordance with one aspect of the present invention, the hanger rods 35 are connected to the outer wall 16 of the internal enclosure 14 in a manner which avoids the need for forming holes in the outer wall and which, at the same time, enables quick and easy installation and removal of the hanger rods from inside of the internal enclosure. Thus, as shown in FIG. 4, a nut metal 40 is located adjacent the outer end of each hanger rod and is simply welded, as indicated at 41, to the inner side of the outer wall 16. The hanger rod is threaded into the nut and, as a result, is fastened securely to the wall. By virtue of the welded nuts, it is not necessary to form holes in the outer wall 16 and then to re-close those holes to prevent the escape of heat from the chamber 11. In addition, installation of the hanger rods and nuts may be accomplished entirely from inside of the chamber and without need of performing assembly operations on both sides of the wall 16.

To insulate the hanger rods 35 electrically from the heating elements 15, a tube 45 (FIG. 4) made of alumina or other ceramic material is telescoped over the inner end portion of each hanger rod. The outer end of the tube abuts the innermost radiation shield 17 while the inner end portion of the tube projects through the hole 36 in the heating element. Two retaining washers 46 made of molybdenum or the like are telescoped over the inner end portion of the hanger rod inwardly of the tube 45 and are captivated on the hanger rod by a wire pin 47 inserted through a hole in the hanger rod. A ceramic washer 48 is sandwiched between the outer retaining washer 46 and the heating element 15 to insulate one from the other, the outer retaining washer covering the ceramic washer. In order to back the curved flexible heating element and hold the element in spaced relation with the innermost shield 17, a ceramic support sleeve 50 is telescoped over the tube 45 and is located with its ends abutting the shield and the heating element.

Figure 5:
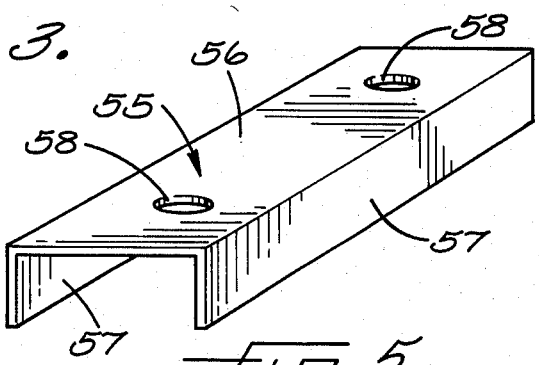
FIG. 5 is a perspective view of one of the shield spacers.

In accordance with another aspect of the invention, spacer members 55 coact with the hanger rods 35 to hold the various radiation shields 17 in spaced apart relation throughout the entire span from hanger rod-to-hanger rod. An exemplary spacer member is shown in FIG. 5 and is in the form of a channel made of thin sheet metal and having a generally U-shaped cross-section, the spacer thus having a web 56 and two legs 57. Two holes 58 are formed through the web 56 and are spaced from one another in accordance with the spacing between two axially spaced hanger rods.

Figure 3:
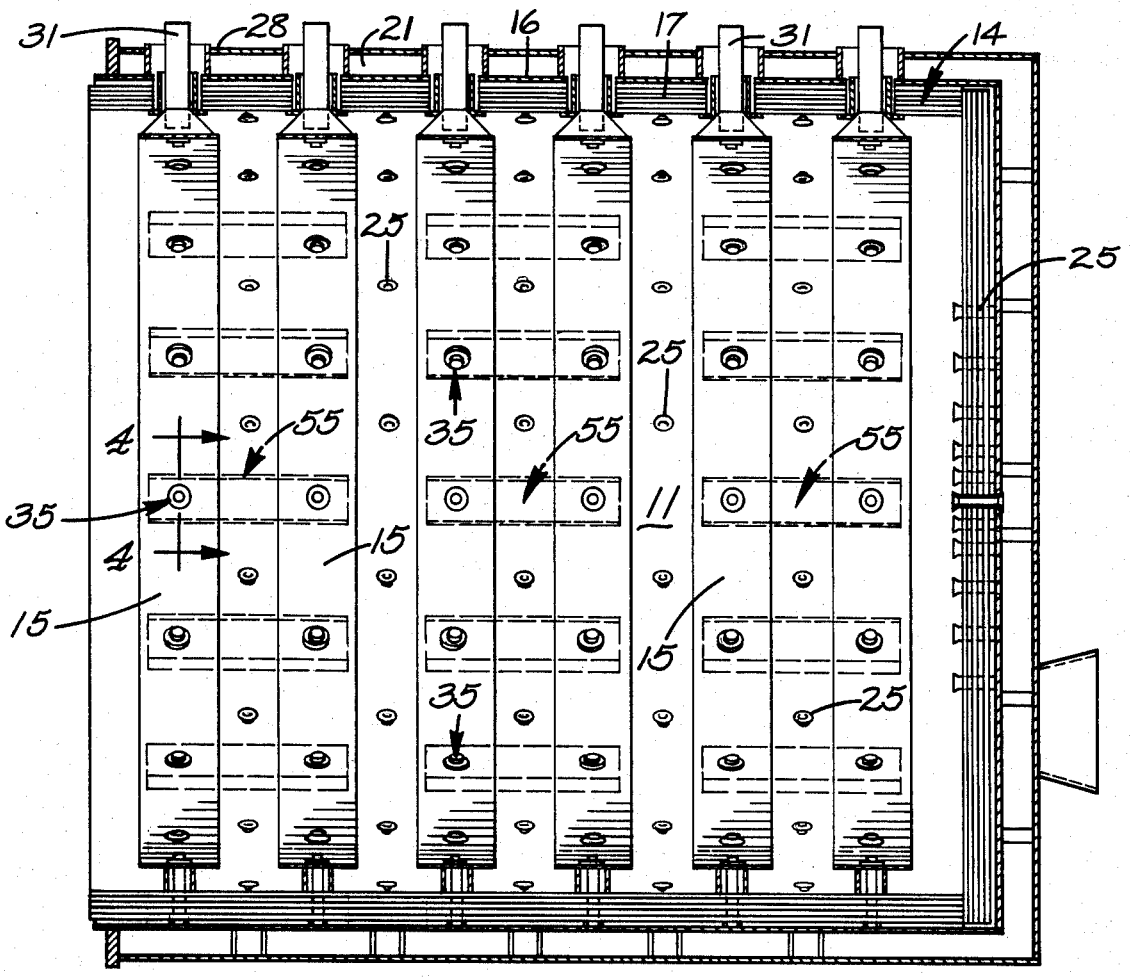
FIG. 3 is a fragmentary cross-section taken substantially along, the line 3—3 of FIG. 2.

The spacers 55 are sandwiched between the various radiation shields 17 adjacent all or selected ones of the hanger rods 35 (see FIGS. 3 and 4). The web 56 of each spacer is disposed in face-to-face engagement with one shield while the free edges of the legs 57 abut the opposing shield. Two hanger rods 35 extend through the holes 58 in each spacer and thus support the spacer between the shields. In turn, the spacer backs the flexible shields and holds the shields in spaced relation over the entire length of the spacer so that the shields are more rigidly supported than is otherwise the case when the shields are merely hung from the rods. The U-shaped cross-section of the spacer tends to minimize heat transfer through the spacer.

Figure 6:
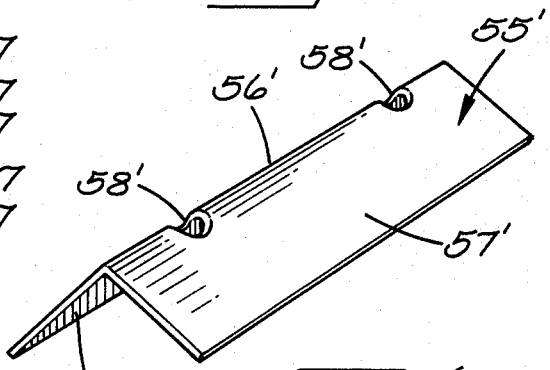
FIG. 6 is a perspective view of a modified form of a shield spacer.

A modified spacer 55' is shown in FIG. 6 and is V-shaped in cross-section, there being two holes 58' formed through the apex 56' of the V. The spacer 55' is located between two shields 17 with the apex of the V engaging one shield, with the free edges of the legs 57' of the V engaging the other shield and with the holes 58' receiving two adjacent hanger rods 35.

We claim:

1. A heat treating furnace comprising wall means defining a work chamber, electric resistance heating elements disposed inside of said chamber for heating workpieces therein, and means for attaching said heating elements to said wall means, said furnace being characterized in that each of said attaching means comprises a threaded nut having an outer end bonded rigidly to the inner side of said wall means, said wall means being imperforate in that area of the wall means directly opposing the entirety of the outer side of said nut, an elongated hanger rod having an outer end portion threaded into said nut and terminating short of the outer side of said wall means, and means for connecting a heating element to and insulating the heating element electrically from the inner end portion of said hanger rod, said wall means comprising an innermost radiation shield spaced outwardly from said heating element, said connecting and insulating means comprising a ceramic tube having an outer end abutting said shield and having an inner end portion extending through a hole in said heating element, the inner end portion of said hanger rod also extending through said hole, said ceramic tube being telescoped over said hanger rod and insulating the inner end portion of said hanger rod from said heating element, a ceramic washer telescoped over the inner end portion of said ceramic tub and abutting the inner side of said heating element adjacent said hole, a retaining washer telescoped over the inner end portion of said hanger rod and covering the inner side of said ceramic washer, said retaining washer being insulated from said heating element by said ceramic washer, and means for captivating said retaining washer on the inner end portion of said hanger rod.

2. A heat treating furnace as defined in claim 1 in which said wall means and said nut are made of metal, said nut being bonded to said wall means by a weld.

3. A heat treating furnace as defined in claim 1 further including a ceramic sleeve telescoped over said ceramic tube and having ends abutting the inner side of said radiation shield and the outer side of said heating element.

4. A heat treating furnace comprising wall means defining a work chamber, electric resistance heating elements disposed inside of said chamber for heating workpieces therein, and means for attaching said heating elements to said wall means, said furnace being characterized in that each of said attaching means comprises a threaded nut having an outer end bonded rigidly to the inner side of said wall means, said wall means being imperforate in that area of the wall means directly opposing the entirety of the outer side of said nut, an elongated hanger rod having an outer end portion threaded into said nut and terminating short of the outer side of said wall means, and means for connecting a heating element to and insulating the heating element electrically from the inner end portion of said hanger rod, said wall means being defined at least in part by two radiation shields made of sheet metal and disposed in spaced apart face-to-face relation, said wall means further being defined by a wall located outwardly of the outermost shield, there being two hanger rods extending through said shields at spaced locations and connected to said wall, and a spacer member located between said shields and holding the shields in spaced relation, said spacer member extending between and being supported by said hanger rods.

5. A heat treating furnace as defined in claim 4 in which said spacer member is in the form of a channel having a substantially U-shaped cross-section, the web of said channel being disposed in face-to-face engagement with one of said shields, the free ends of the legs of the channel being disposed in engagement with the other of said shields, and spaced holes formed through said web for receiving said hanger rods.

6. A heat treating furnace as defined in claim 4 in which said spacer member is generally V-shaped, said spacer member being located with the free edges of the legs of the V engaging one of said shields and with the apex of the V engaging the other shield, and spaced holes formed through said apex for receiving said hanger rods.

7. A heat treating furnace comprising wall means defining a work chamber, electric resistance heating elements disposed inside of said chamber for heating workpieces therein, said wall means comprising an outer wall and comprising at least two radiation shields made of sheet metal, said shields being located between and being spaced from said outer wall and said heating elements and being located in spaced apart face-to-face relation with one another, and spaced hanger rods extending inwardly from said outer wall, extending through said shields and having inner end portions connected to said heating elements to support the heating elements within said chamber, the improvement in said heat treating furnace comprising, spacer members extending between said shields and holding said shields in spaced relation, each of said spacer members extending between and being supported by at least two of said hanger rods.

8. A heat treating furnace as defined in claim 7 in which each of said spacer members is formed with at least two spaced holes for receiving said hanger rods.

9. A heat treating furnace as defined in claim 7 in which each spacer member is in the form of a channel having a substantially U-shaped cross-section, the web of said channel being disposed in face-to-face engagement with one of said shields, the free ends of the legs of the channel being disposed in engagement with the other of said shields, and spaced holes formed through said web for receiving said hanger rods.

10. A heat treating furnace as defined in claim 7 in which each of said spacer members is generally V-shaped, said spacer member being located with the free edges of the legs of the V engaging one of said shields and with the apex of the V engaging the other shield, and spaced holes formed through said apex for receiving said hanger rods.

11. A heat treating furnace as defined in claim 7 in which the outer end portion of each of said hanger rods is threaded, and threaded nuts welded to the inner side of said outer wall and receiving the threaded outer end portions of said hanger rods, said outer wall being imperforate adjacent the outer sides of said nuts.

12. A heat treating furnace comprising wall means defining a work chamber, electric resistance heating elements disposed inside of said chamber for heating workpieces therein, said wall means comprising an outer wall and comprising at least two radiation shields made of sheet metal, said shields being located between and being spaced from said outer wall and said heating elements and being located in spaced apart face-to-face relation with one another, spaced hanger rods extending inwardly from said outer wall and through said shields, and means for captivating said shields on said hanger rods, the improvement in said heat treating furnace comprising, spacer members extending between said shields and holding said shields in spaced relation, each of said spacer members extending between and being supported by at least two of said hanger rods.

* * * * *